US005315769A

United States Patent [19]

Barry et al.

[11] Patent Number: 5,315,769

[45] Date of Patent: May 31, 1994

[54] TEARDROP PROPULSION PLATE FOOTWEAR

[76] Inventors: Daniel T. Barry, 1413 Granger Ave., Ann Arbor, Mich. 48104; Raymond M. Fredericksen, 2346 Graystone; Robert W. Soutas-Little, 2402 Sullett Rd., both of Okemos, Mich. 48864; Ruk R. Peterson, 55 Mayfair, NE., Grand Rapids, Mich. 49351

[21] Appl. No.: 91,540

[22] Filed: Jul. 12, 1993

Related U.S. Application Data

[63] Continuation of Ser. No. 742,435, Aug. 8, 1991, abandoned, which is a continuation-in-part of Ser. No. 510,671, Apr. 18, 1990, Pat. No. 5,052,130, which is a continuation-in-part of Ser. No. 131,309, Dec. 8, 1987, abandoned, which is a continuation-in-part of Ser. No. 942,245, Dec. 15, 1986, abandoned.

[51] Int. Cl.[5] ..... A43B 13/18; A43B 19/00; A43B 13/12

[52] U.S. Cl. ..... 36/114; 36/28; 36/107

[58] Field of Search ..... 36/114, 107, 108, 28, 36/30 R, 27, 76 C, 31, 102, 140, 154, 173, 178, 181, 29

[56] References Cited

U.S. PATENT DOCUMENTS

| | | | |
|---|---|---|---|
| 75,900 | 3/1868 | Hale et al. . | |
| 180,819 | 8/1876 | Ames . | |
| 634,588 | 10/1899 | Roche . | |
| 872,615 | 12/1907 | Eastman | 36/25.2 |
| 898,951 | 9/1908 | Zooboavch . | |
| 1,751,990 | 3/1930 | Gilkerson | 36/28 |
| 1,907,136 | 5/1933 | Weitsen . | |
| 2,049,604 | 8/1936 | Cristallini . | |
| 2,185,993 | 10/1937 | Haskell . | |
| 2,330,398 | 9/1943 | Vass . | |
| 2,475,417 | 1/1947 | Wysowski | 128/80 |
| 3,039,207 | 9/1955 | Lincors | 36/58.5 |
| 3,835,558 | 9/1974 | Revill | 36/44 |
| 4,081,917 | 4/1978 | Bradley et al. | 36/76 |
| 4,231,169 | 10/1980 | Toyama et al. | 36/43 |
| 4,360,027 | 10/1982 | Friedlander et al. | 128/581 |
| 4,404,757 | 9/1983 | Sweeny | 36/107 |
| 4,439,934 | 4/1984 | Brown | 36/44 |
| 4,454,662 | 6/1984 | Stubblefield | 36/91 |
| 4,463,505 | 8/1984 | Duclos | 36/30 |
| 4,481,726 | 11/1984 | Phillips | 36/30 |
| 4,486,964 | 12/1984 | Rudy | 36/28 |
| 4,492,046 | 1/1985 | Kosova | 36/27 |
| 4,510,700 | 4/1985 | Brown | 36/44 |
| 4,520,581 | 6/1985 | Irwin et al. | 36/88 |
| 4,534,124 | 8/1985 | Schnell | 36/114 |
| 4,542,598 | 9/1985 | Misevich et al. | 36/114 |
| 4,597,195 | 7/1986 | Dananberg | 36/28 |
| 4,598,486 | 7/1986 | Olivieri | 36/96 |
| 4,612,713 | 9/1986 | Brown | 36/44 |
| 4,615,126 | 10/1986 | Mathews | 36/102 |
| 4,628,621 | 12/1986 | Brown | 36/44 |
| 4,651,445 | 3/1987 | Hannibal | 36/103 |
| 4,774,954 | 10/1988 | Ibrahim | 128/581 |
| 4,815,221 | 3/1989 | Diaz | 36/27 |
| 4,854,057 | 8/1989 | Misevich et al. | 36/114 |
| 4,858,338 | 8/1989 | Schmid | 36/44 |
| 4,878,300 | 11/1989 | Bogaty | 36/35 |
| 4,934,072 | 6/1990 | Fredericksen et al. | 36/29 |
| 5,052,130 | 10/1991 | Barry et al. | 36/107 |

FOREIGN PATENT DOCUMENTS

| | | |
|---|---|---|
| 5601173 | 10/1974 | Australia . |
| 3126301 | 1/1983 | Fed. Rep. of Germany . |
| 3318181 | 10/1984 | Fed. Rep. of Germany . |
| 475731 | 11/1952 | Italy . |
| 12550 | 3/1907 | United Kingdom . |

OTHER PUBLICATIONS

"The Spring in Your Step," by R. McNeill Alexander, *New Scientist*, Apr. 30, 1987.

"Shoes With Rebound Effect Soles," *American Journal of Physiological Medicine*, p. 37, Feb. 1987.

*Primary Examiner*—Steven N. Meyers

*Attorney, Agent, or Firm*—Seed and Berry

[57] ABSTRACT

An athletic shoe with a teardrop shaped spring plate in combination with a dynamic fluid heel pad and a visco-elastic midsole, such spring plate being basically symmetrical about its longitudinal axis, and lying forwardly of the fluid pad, having its widest dimension beneath the metatarsal head area and curving gradually up and beneath the phalanges. The spring plate, of multiple layers of parallel fibers embedded in polymer, combines with the heel pad to effect foot control stability, as well as extending useful life to the midsole and footwear.

9 Claims, 2 Drawing Sheets

TEARDROP PROPULSION PLATE FOOTWEAR

RELATED APPLICATION

This application is a continuation of U.S. application Ser. No. 07/742,435, filed Aug. 8, 1991, now abandoned, which is a continuation-in-part application of pending U.S. application Ser. No. 510,671, filed Apr. 18, 1990, now U.S. Pat. No. 5,052,130 entitled SPRING PLATE SHOE, which is a continuation-in-part application of U.S. application Ser. No. 131,309, filed Dec. 8, 1987, now abandoned entitled SHOE WITH SPRING-LIKE SOLE MEMBER, which is a continuation-in-part application of U.S. application Ser. No. 942,245, filed Dec. 15, 1986, now abandoned entitled SHOE WITH SPRING-LIKE SOLE MEMBER. This application is also related to U.S. Pat. No. 5,191,727, entitled PROPULSION PLATE HYDRODYNAMIC FOOTWEAR.

BACKGROUND OF THE INVENTION

This invention relates to footwear, and particularly to athletic footwear.

In copending application Ser. No. 510,671, is disclosed footwear incorporating a special propulsion plate extending from the medial portion of the heel through the arch to a position forwardly of the metatarsal heads. This construction has been found highly effective in cooperating with the spring energy of the natural biomechanism of the foot, storing energy and then releasing the energy in response to flexure during each step. This specially configurated plate is formed of layers of oriented fibers, normally carbon (graphite) fiber, embedded in polymer. Each plate is specially formed and configurated to fit the left foot, or formed to fit the right foot, and is formed of the size necessary. The cost of making each unit and the required inventory of units for a variety of shoe sizes is substantial, as can be readily realized.

The midsole for athletic shoes is typically formed of a foam polymer such as expanded ethylene vinyl acetate polymer (EVA). Such midsole materials break down with usage, thereby lessening control by a runner of his/her feet, and also shortening shoe life.

SUMMARY OF THE INVENTION

The present invention provides an athletic shoe, a novel propulsion plate for an athletic shoe, and a method of making propulsion plates involving considerably less expense than the prior device. Each propulsion plate has a generally teardrop shaped periphery suitable for both the left and the right shoe. Such a teardrop shape includes a globular form at the front, tapering to an apex at the rear. The widest part of the teardrop shape is beneath the metatarsal heads, with the plate tapering forwardly of the metatarsal heads to a narrower width. The narrow convergent rear isthmus of the teardrop shape extends into the arch area of the shoe/foot and terminates ahead of the heel. The teardrop plate is preferably mounted beneath the midsole, between the midsole and the outsole, and anchored over its length to the midsole and the outsole. The peripheral configuration is basically symmetrical except for an optional orientation indicia on one side. It preferably has the fibers oriented and mounted to create a flexure bias forwardly toward the lateral side, i.e., outer side of the shoe. Forwardly of the metatarsal heads, the plate curves upwardly beneath the phalanges.

The plate is particularly effective in combination with a rear viscous flow pad. Therefore, another object of the invention is to provide a shoe which houses a viscous flow pad in the heel portion, and a propulsion plate in the forefoot portion extending back beneath the arch portion and terminating ahead of the heel portion. The plate is of teardrop shape, having the apex in the arch portion. It is basically elastic, with practically no viscous compressibility. The pad is basically viscous with little or no bending elasticity.

These and other objects, advantages and features of the invention will become apparent upon studying the detailed specification to follow, in conjunction with the drawings.

DETAILED DESCRIPTION OF THE PREFERRED EMBODIMENT

The novel shoe structure of this invention combines a teardrop configurated spring plate with a viscous fluid pad to achieve a sole structure with excellent foot control, maintaining an extended useful life for the midsole and extending the controlled-foot, useful life of the shoe.

Modern athletic type shoes achieve markedly superior characteristics over those of some years ago. Much of this improvement is due to the sole assembly, particularly the midsole features. The extreme impact force spike at the heel is alleviated by the special pad in U.S. Pat. No. 4,934,072. The foot then proceeds through the gait cycle to ultimate toe off, performing the gait by a remarkably complex foot action which has been shown to ultimately result in breakdown of the midsole structure. This breakdown occurs somewhat gradually, such that foot control is gradually lost, resulting in over pronation, over supination or other undesirable movements.

The present invention employs a combination which cooperatively functions to alleviate this loss of foot control tendency and extend the useful life of the footwear.

Figure 7:
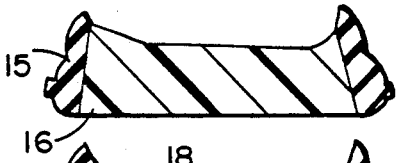
FIG. 7 is a sectional view taken on plane VII—VII of FIG. 2.
Figure 8:
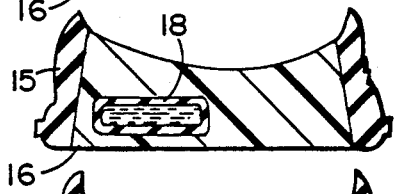
FIG. 8 is a sectional view taken on plane VIII—VIII of FIG. 2.
Figure 9:
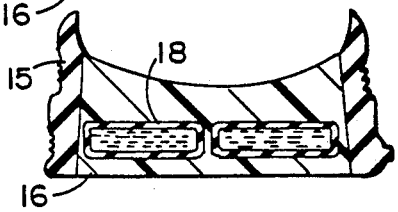
FIG. 9 is a sectional view taken on plane IX—IX of FIG. 2.

A runner will typically contact the ground with a vertical ground reaction force of approximately 2.5 to 3.0 times his/her body weight. Examination of the vertical force plot reveals there are actually two maximum load peaks. The first peak occurs very rapidly and is associated with initial foot impact. The second, more slowly rising peak is associated with foot propulsion as the heel is lifted off the ground and load is shifted to the metatarsal heads of the forefoot. Also, during the contact phase, a runner will exhibit a braking and propulsive ground reaction force that will coincide with the vertical force. The third ground reaction force component is a medial-lateral force associated with the internal and external rotation of the foot and leg. These three vector force components are illustrated in FIG. 7 of copending application Ser. No. 510,671 referenced above.

A runner typically contacts the ground heel first, usually on the lateral portion of the heel, with the foot in a rigid supinated position. Immediately after contact, the foot switches from a rigid structure to a mobile one, as it pronates to attenuate the ground reaction forces associate with heel strike. At maximum midstance pronation, the foot then resupinates and the arch of the foot is returned to a rigid structure to allow for stable propulsion at toeoff. The motion sequence of pronation and supination of the foot is the body's natural mechanism for attenuating impact shock and storing potential energy for propulsion. The novel shoe herein effects impact cushion at heel strike, stability and control during the gait cycle, and spring action toe off. In achieving these characteristics, it employs a combination teardrop spring plate and a fluid heel pad, especially in combination with a viscous foam midsole.

In the heel region to the rear of the propulsion plate is the viscous fluid pad or bladder, housed in a cavity of the midsole. The midsole is made of a cellular viscous polymer.

The propulsion plate herein is an elastic unit of teardrop configuration, basically symmetrical, which is incorporated into a left or a right running shoe midsole.

The teardrop spring plate has its greatest width in the metatarsal head area of the forefoot position of the shoe, and extends forwardly beneath the phalanges, the edges of the plate tapering forwardly toward each other. This forward portion also curves gradually upwardly. The plate also extends rearwardly from the metatarsal head area to the arch portion of the shoe, the edges thereof tapering toward each other to an apex beneath the arch and ahead of the viscous pad to be discussed. The plate is basically symmetrical about a longitudinal centerline of the plate.

The propulsion plate consists of multiple layers of polymer and elongated fibers, preferably carbon, i.e. graphite fibers, placed in alignment to each other. Each layer consists of unidirectional, i.e., parallel, fibers preferably preimpregnated in a resin which is preferably an epoxy resin. By changing the alignment of fibers in the adjacent layers relative to each other, the stiffness and bending characteristics of the plate can be adjusted, as is known. The fiber layers are normally arranged such that there is a bias toward the forward lateral side of the shoe. This can be readily done by having the fibers in the outermost layers extending generally normal to this bias, i.e., extending diagonally forwardly toward the medial side.

The plate terminates a small amount from the front and side edges of the midsole to prevent the rather sharp edges of the plate from cutting anything or anyone, and to allow adequate adhesive area between the overlying midsole and the underlying outsole in these areas.

Referring now specifically to the drawings, an illustrative embodiment incorporating the invention is disclosed in the form of an athletic shoe 10 having an upper 12 secured to a sole subassembly 13.

Figure 1:
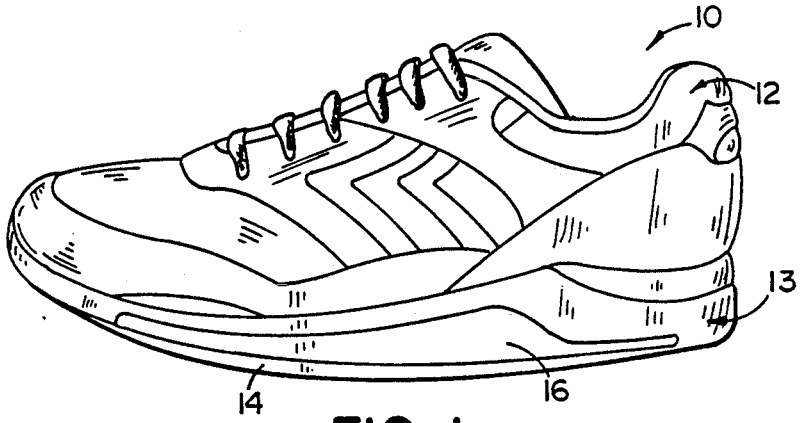
FIG. 1 is a perspective view for the lateral side of the left shoe of the novel construction.

The upper may be of a variety of configurations and/or constructions such as those well known in the art. The upper is secured to the sole assembly by stitching and/or adhesive, using any of a variety of well known techniques. The sole subassembly comprises an outer sole 14, a midsole 16, a specially configurated spring plate 17 between the outer sole and midsole, and a viscous fluid pad 18 in a like shaped recess of the midsole heel portion. The outer sole is formed of conventional abrasion resistant material such as rubber, the heel part of the outsole optionally being of a higher durometer material than the remainder of the outsole. FIG. 1 depicts the outsole extending up over the midsole and a portion of the upper at the toe to inhibit toe scuffing, in conventional fashion. The midsole preferably has a peripheral protective rim 15.

Midsole 16 is formed of a conventional viscous elastic material such as foam ethylene vinyl acetate polymer (EVA), polyurethane (PU), or other viscoelastic, polymeric, expanded, cellular material. The heel area of the midsole has a cavity which contains the dynamic viscous fluid structure 18 disclosed in U.S. Pat. No. 4,934,072, issued Jun. 19, 1990, entitled Fluid Dynamic Shoe, and incorporated herein by reference. Spring plate 17 is bonded between the midsole and outsole, terminating just short at the front end and the side edges of the midsole sufficient amounts to prevent the edges of the plate from being exposed to thereby cut materials, things or persons, and to achieve effective bonding between the midsole and outsole in these regions. The midsole 16, spring plate 17 and outsole 14 are bonded to each other by a suitable adhesive such as those typically used in the shoe trade. The finished shoe may also include a conventional inner sole and sock liner (not shown).

The specific structure of the spring plate illustrated, as previously noted, is of multiple layers of polymer embedded elongated fibers, preferably carbon fibers, (otherwise designated graphite fibers), so as to be embodied by the polymer matrix, preferably of an epoxy resin. Each individual layer has the fibers therein extending in the same direction, i.e., to be basically parallel to each other, the fibers being laid side-by-side. The individual layers are bonded to each other. In the preferred embodiment, one layer is arranged relative to the adjacent layer to cause the fibers to be at an acute angle to each other of about 60°, plus or minus about 10°, i.e., about 30° relative to the longitudinal axis of the shoe sole assembly. There is normally an even number of layers, preferably four, so that the total grouping of fibers constitutes a symmetrical arrangement and flexing action. The top and bottom layers preferably have the fibers oriented diagonally forwardly toward the medial side to create a slight forward bias toward the lateral side. The fibers in this angular arrangement also create an anisotropic stiffness, with greater stiffness longitudinally than laterally of the sole. The spring plate has flexibility with inherent memory to return it to its original molded configuration.

Figure 2:
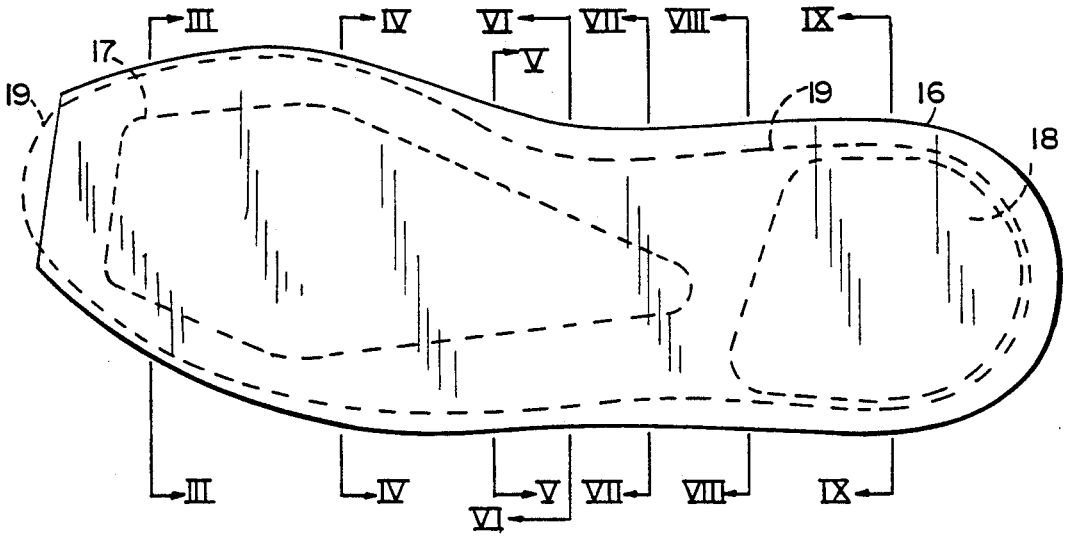
FIG. 2 is an outline top view of the novel sole assembly of a shoe of the novel construction.
Figure 10:
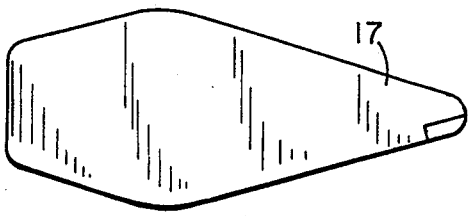
FIG. 10 is a plan view of the novel teardrop propulsion plate.
Figure 11:
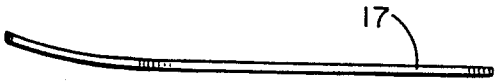
FIG. 11 is an elevational view of the novel teardrop propulsion plate.
Figure 14:
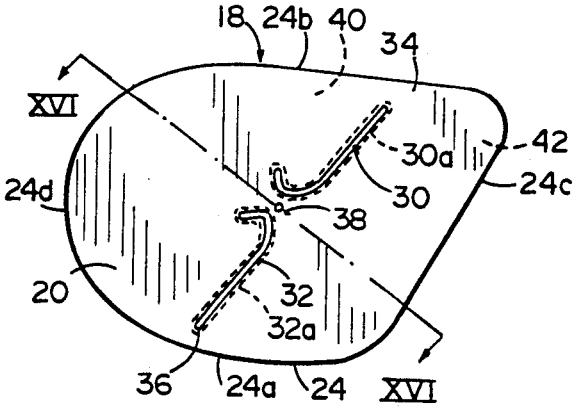
FIG. 14 is a top plan view of the hydrodynamic bladder insert.
Figure 16:
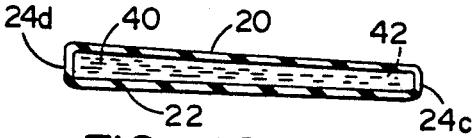
FIG. 16 is a sectional view taken on plane XVI-XVI of FIG. 14.
Figure 15:
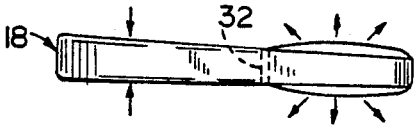
FIG. 15 is a side elevational view of the bladder, shown with pressure applied to its rear chamber as occurs during heel strike, causing the front heel chamber to bulge.

The special teardrop configuration of the spring plate is depicted in FIGS. 2, 10 and 11, with FIG. 2 showing the spring plate relative to the outline of the midsole 16 and relative to the foot cavity 19 shown in outline. During use of a shoe, ground reaction forces occur as the shoe engages the ground. Specifically, there is a vertical ground reaction force, a longitudinal braking and propulsive ground reaction force, and a transverse lateral-medial ground reaction force. The center of pressure is the resultant force of these three directional ground reaction forces, i.e., vertical, fore to aft horizontal and transverse. The center of pressure pattern represents the orientation, magnitude and position of where the resultant ground reaction force enters the body. It also provides a sense of how the center of mass of the body is transferred from heel contact to toe off during gait.

Figure 13:
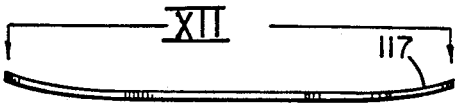
FIG. 13 is an elevational view of the sheet in FIG. 12.
Figure 12:
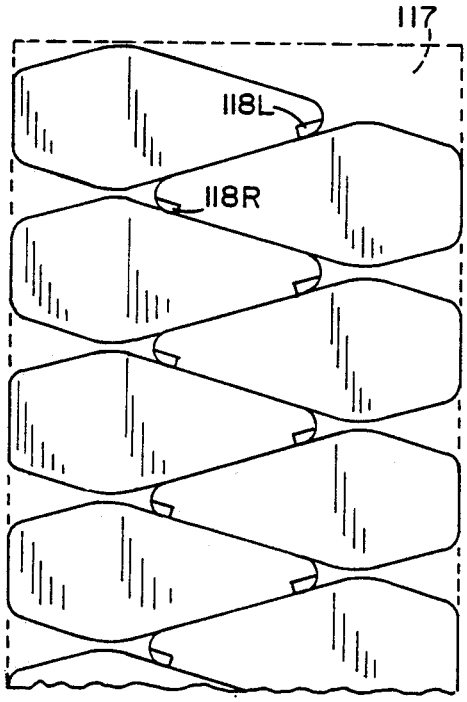
FIG. 12 is a plan view of a sheet of a plurality of the propulsion plates as formed, taken in the direction XII—XII in FIG. 13.

The teardrop plates 17 are formed from a sheet 117 (FIGS. 12 and 13) which is preformed of multiple layers bonded together and curled up on at least one and preferably both side edges. The fibers in this sheet are all oriented to create a small bias in one direction, e.g., upper left and lower right. Hence, the plates on the left side of sheet 117 would be for the left foot, and those on the right side for the right foot, so that they all had a forward bias to the lateral side. The plurality of spring plates are then die-cut end-to-end as depicted. Normally an indicia indicating the lateral edge of the plate is applied, e.g., a notch as at 118R and 188L, to mark the medial side of the plates, whether for the left shoe or the right shoe. Still the teardrop plates are essentially symmetrical relative to the longitudinal axis thereof.

In the rear of the midsole is retained the special bladder structure 18 depicted in outline in FIG. 2. It forms a viscous pad. The bladder structure 21 is formed of a flexible polymeric material, preferably polyethyl vinyl acetate, or polyurethane, or the equivalent, having a wall thickness of approximately 1–2 mm and including an upper wall 20, a lower wall 22 spaced from the upper wall, and a peripheral wall 24 comprising a medial sidewall **24*a*, a lateral sidewall 24*b*, a diagonal front wall 24*c* and a convexly curved rear wall 24*d*. Front wall 24*c*** is at an angle of about 25 degrees to a line transverse to the unit, with the lateral wall being longer than the medial wall. The peripheral wall is integrally joined with the upper and lower walls to form an enclosed space or chamber. It has been determined that the height of the bladder body should be about 10 mm at the thickest, i.e., rear-medial, portion thereof, tapering toward the forward end to about 7 mm. This taper in the bladder from rear to front assists in causing bulging in the front chamber, and enabling rapid return flow of liquid to the rear chamber, the front chamber being smaller than the rear chamber.

Intermediate these two extremities, therefore, the height is approximately 8 to 8½ mm. Since the polymeric material forming the bladder is preferably approximately 1 mm thick, the height of the openings 34, 36 and 38 thus is approximately 4 to 6½ mm, for an overall cross sectional area of 16 to 26 sq. mm for each passageway. Preferably the height and width of each of the three is 4 mm. The total area of the three orifices forming the passage means is about 48 to 78 sq. mm. The orifices should comprise 10 to 25 percent of the total cross sectional divider area between the front and rear chambers. If the ratio of flow opening is too large, or too small, the pad will tend to undesirably act solely like a spring. The pad also may taper from the medial portion to the lateral portion.

Figure 3:
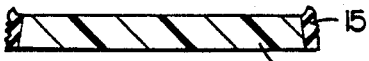
FIG. 3 is a sectional view taken on plane III—III of FIG. 2.
Figure 4:
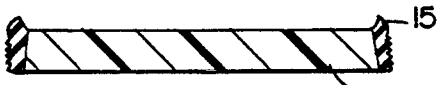
FIG. 4 is a sectional view taken on plane IV—IV of FIG. 2.
Figure 5:
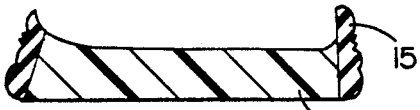
FIG. 5 is a sectional view taken on plane V—V of FIG. 2.
Figure 6:
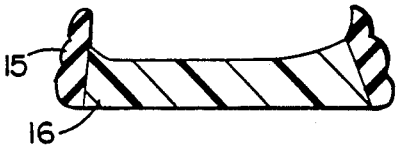
FIG. 6 is a sectional view taken on plane VI—VI of FIG. 2.

An integral interior diagonal control wall structure extends across the enclosed space. This is formed by two J-shaped, mirror image elongated vertical openings 30 and 32 through the thickness of the insert, including the upper wall and lower wall, to form adjacent wall members. This may be achieved by placing transverse J-shaped core members in the mold when forming the bladder such that a double wall **30*a* and 32*a* is formed adjacent each of these J-shaped openings 30 and 32 as indicated by the dotted lines in FIG. 3. The curved ends of these J-shaped openings are adjacent to and spaced from each other and curve convexly toward each other to form a venturi therebetween. The main straight portions of these J-shaped elements extend diagonally across the chamber, colinearly with each other, leaving an opening at the outer ends, i.e. between the outer ends of the control wall and the lateral and medial sidewalls. The walls therefore define three flow control orifices or openings 34, 36 and 38 therebetween for viscous fluid flow control or gate means as explained hereinafter. The lateral side opening 34, the medial side opening 36 and the central opening 38** are each preferably 3 to 4 mm in width when employing a silicone fluid having a viscosity of about 1000 centistokes. The height of each opening is about 6½ mm.

As noted previously, most persons have heel first contact. Further, persons who have heel first contact typically strike at the lateral rear corner of the heel, with a subsequent foot strike line of stress or center of pressure extending diagonally toward the midpoint of the heel and then longitudinally forwardly during foot roll to ultimate toe off from the great toe. The diagonal control wall structure separates the sealed space underlying the heel into a rear heel chamber 40 and a front heel chamber 42. The control wall extends at an angle basically normal to the foot strike line of stress experienced by most persons (basically between the dots along the left outer half of the phantom line in FIG. 3 of U.S. Pat. No. 4,934,072). The control wall is thus at an angle of about 35 degrees to a line transverse of the heel, and about 55 degrees to a longitudinal line bisecting the heel structure.

Rear heel chamber 40 is purposely caused to be substantially larger in volume than front heel chamber 42 by location of the wall and taper of the structure. Optimally, rear heel chamber 40 comprises 60 percent of the total volume, while front heel chamber 42 comprises 40 percent of the total volume. The quantity of viscous liquid in the total space is greater than the volume of front heel chamber 42. The amount of viscous liquid is preferably sufficient to fill approximately 80 to 90 percent of the total volume, leaving 10 to 20 percent for a gas such as air. It is important to always have a significant quantity of liquid in the rear heel chamber at the time of heel impact. This is aided by having an amount of total viscous liquid greater than the volume of the front heel chamber. This is also aided by having the front or forward chamber walls resiliently flexible to bulge, such that momentarily the amount of fluid in the forward chamber is greater than the at-rest volume of the front chamber, thereby creating part of the return bias force on the liquid due to the memory of the polymer. Additional return bias force is caused by momentary compression of air in the front chamber with forced flow of the liquid into that chamber. Further, the tapered construction enables the rear chamber to have the desired greater volume as previously noted.

Silicone fluid is preferably employed in this bladder because it is temperature stable, viscosity constant and nontoxic, as well as an excellent dampener. The viscosity employed is preferably about 1000 centistokes for an orifice to wall ratio factor in the range of 10 to 25 percent, preferably about 20 percent. The preferred range of viscosity is 1000 to 1250 centistokes. Above 1250 it tends to become too viscous for optimum forward and return flow actions. Below about 800, it tends to be too fluid for normal running events of average sized person in the structure depicted. If the lower viscosity liquid is employed, the area of flow through the control wall should be decreased also, and vice versa.

In action, as the typical runner's heel strikes at the junction of the lateral side and the convex rear wall, and moves along the strike line of stress diagonally forwardly toward the center of the heel, the top wall of the rear chamber is flexibly depressed so that the silicone liquid is forced under pressure through the three flow control orifices to the front heel chamber in a controlled manner. Increased liquid in forward chamber 42 causes the forward chamber walls, particularly its top wall 20, to temporarily resiliently bulge, thereby creating a return pressure. As the foot strike line of stress moves to the center and then forwardly, the strike impact is attenuated, decreasing the peak force load considerably from what it would otherwise be, and extending the time period of the strike load. This occurs entirely beneath the heel. As the foot proceeds through its typical foot roll and toe off stages of the gait, pressure is released from the rear heel chamber, pressure is momentarily applied to the top of the front heel chamber, and the bulging resilient wall of the front heel chamber applies further pressure, so that pressurized fluid in the front heel chamber flows back through the three orifices into the rear chamber. As the heel begins to lift, the ground reaction force is shifted through the arch and onto the metatarsals. As this occurs, the teardrop plate controls foot movement to stabilize the foot, as well as flexing to store spring energy. As the foot proceeds up onto the great toe, the strike line of stress advances, with concomitant further flexing of the symmetrical plate to store more energy. At toe off, the energy is returned from the teardrop plate in an outwardly biasing orientation relative to the foot for smooth, rapid toe off.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention and show the preferred embodiment thereof, and should not be construed to limit the scope thereof.

The embodiments of the invention in which an exclusive property or privilege is claimed are defined as follows.

1. An athletic shoe having a forefoot portion including a metatarsal head area, an arch portion and a rear foot portion, comprising:

an upper subassembly;

a sole subassembly comprising a midsole and an outsole;

a teardrop configurated, laminated spring plate in said sole subassembly, formed of layers of elongated fibers embedded in polymer;

said spring plate having its greatest width in said metatarsal head area of the shoe for extending beneath the metatarsal heads of the foot;

said plate having side edges tapering toward each other forwardly from said metatarsal head area, and tapering rearwardly toward each other from said metatarsal head area and converging in a rounded apex at said arch portion;

said midsole having a cavity in said rear foot portion; and a viscous fluid pad in said cavity, said pad being rearwardly of said apex and being arranged in combination with said spring plate such that ground reaction forces generated by impact of a wearer's foot are redirected upwardly and forwardly toward the metatarsal head area, comprising:

a bladder having an upper wall, a lower wall spaced from said upper wall and peripheral wall joining said upper and lower walls, including a medial side wall and a lateral side wall connected by a front wall and merging into a curvilinear rear wall, said walls defining a sealed space therebetween;

an interior control wall between said upper and lower walls and extending diagonally generally toward said medial and lateral sidewalls, dividing said space into a front heel chamber and a rear heel chamber;

a viscous liquid and gas mixture filling said chambers; at least one of said lower wall and said upper wall being flexible to allow front heel chamber volume expansion under pressure to a volume greater than the at-rest volume thereof;

said interior control wall having restrictive gate means allowing controlled dynamic flow of said viscous liquid between said chambers for controlled flow from said rear heel chamber to said front heel chamber during initial heel strike and to also cause front chamber volume expansion for impact attenuation and cushioning during heel strike, and for return flow from said expanded front heel chamber to said rear heel chamber during foot roll.

2. The shoe in claim 1 wherein said interior control wall is transverse to a foot strike line of stress that extends from the area of merger of said lateral sidewall and said curvilinear rear wall, diagonally toward the center of said space.

3. The shoe in claim 1 wherein said plate forwardly of said greatest width curves upwardly.

4. The shoe in claim 1 wherein said plate is substantially symmetrical about a longitudinal axis.

5. The shoe in claim 1 wherein said rear heel chamber has a greater volume than said front heel chamber, and said viscous liquid is greater in volume than the volume of said front heel chamber.

6. A sole subassembly for an athletic shoe comprising a midsole and an outsole having a forefoot portion including a metatarsal head area, an arch portion and a rear foot portion;

a teardrop configurated laminated spring plate formed of layers of elongated fibers embedded in polymer;

said spring plate having its greatest width in said metatarsal head area of the shoe for extending beneath the metatarsal heads of the foot;

said plate having side edges tapering toward each other forwardly from said metatarsal head area, and tapering rearwardly toward each other from said metatarsal head area and converging in a rounded apex at said arch portion;

said midsole having a cavity in said rear foot portion; and a viscous fluid pad in said cavity, said pad being rearwardly of said apex and being arranged in combination with said spring plate such that ground reaction forces generated by impact of a wearer's foot are redirected upwardly and forwardly toward the metatarsal head area, comprising:

a bladder having an upper wall, a lower wall spaced from said upper wall and peripheral wall joining said upper and lower walls, including a medial side wall and a lateral side wall connected by a front wall and merging into a curvilinear rear wall, said walls defining a sealed space therebetween;

an interior control wall between said upper and lower walls and extending diagonally generally toward said medial and lateral sidewalls, dividing said space into a front heel chamber and a rear heel chamber;

a viscous liquid and gas mixture filling said chambers;

at least one of said lower wall and said upper wall being flexible to allow front heel chamber volume expansion under pressure to a volume greater than the at-rest volume thereof;

said interior control wall having restrictive gate means allowing controlled dynamic flow of said viscous liquid between said chambers for controlled flow from said rear heel chamber to said front heel chamber during initial heel strike and to also cause front chamber volume expansion for impact attenuation and cushioning during heel strike, and for return flow from said expanded front heel chamber to said rear heel chamber during foot roll.

7. The shoe in claim 6 wherein said plate is substantially symmetrical about a longitudinal axis.

8. The shoe in claim 7 wherein said plate forwardly of said greatest width curves upwardly.

9. The shoe in claim 6 wherein said rear heel chamber has a greater volume than said front heel chamber, and said viscous liquid is greater in volume than the volume of said front heel chamber; and said interior control wall is transverse to a foot strike line of stress that extends from the area of merger of said lateral side wall and said curvilinear rear wall, diagonally toward the center of said space.

* * * * *